US006036396A

United States Patent [19]

Gottdiener

[11] Patent Number: 6,036,396

[45] Date of Patent: Mar. 14, 2000

[54] REMOVABLE PROTECTOR FOR A PAGE OF SAMPLE BOOK

[75] Inventor: Gary S. Gottdiener, Westfield, N.J.

[73] Assignee: International Service Investors, LLC, Elizabeth, N.J.

[21] Appl. No.: 08/518,540

[22] Filed: Aug. 23, 1995

[51] Int. Cl.[7] ..... B42F 13/00

[52] U.S. Cl. ..... 402/80 L

[58] Field of Search ..... 402/60, 68, 80 L, 402/80 R, 80 P

[56] References Cited

U.S. PATENT DOCUMENTS

| | | | |
|---|---|---|---|
| 1,280,131 | 10/1918 | Bakka . | |
| 2,521,792 | 9/1950 | Hollander . | |
| 3,200,527 | 8/1965 | Clark | 40/705 |
| 4,180,340 | 12/1979 | Cosby | 402/68 X |
| 4,340,316 | 7/1982 | Jahn | 402/68 |
| 4,657,422 | 4/1987 | Underwood | 402/68 X |
| 5,000,319 | 3/1991 | Mermelstein . | |
| 5,259,683 | 11/1993 | Lubbe | 402/68 |
| 5,323,552 | 6/1994 | Fritz . | |

*Primary Examiner*—Willmon Fridie, Jr.

*Attorney, Agent, or Firm*—Lerner, David, Littenberg, Krumholz & Mentlik

[57] ABSTRACT

A removable page protector for a sample book includes first and second elongated members which, in assembled relationship on a page, produce a protective reinforcement along the free edge of the page and the top and bottom edges adjacent thereto. Connecting units spaced from one another along the length of the elongated members enable the elongated members to be removably connected to one another. When assembled on a page, the elongated members form a multiplicity of receiving pockets, each of which is bounded by one or more connecting units, the sample page and the inside surface of the elongated member facing the sample page. These receiving pockets may be used to hold an end of a sample card in assembled relationship to the sample page.

16 Claims, 4 Drawing Sheets

REMOVABLE PROTECTOR FOR A PAGE OF SAMPLE BOOK

FIELD OF THE INVENTION

The present invention relates to the art of sample books enabling a user to collect, carry and demonstrate a multiplicity of samples, and more specifically it relates to page protectors for such sample books.

BACKGROUND OF THE INVENTION

An important advantage of sample books used by a sales force is that a multiplicity of well organized samples of products can be efficiently demonstrated to a potential customer during a limited time of a business meeting. Furthermore, such sample books enable a sales person to well organize samples of demonstrated products so that a well-planned, prearranged presentation can be conducted on a short time notice. One of the most popular types of sample books is a multipage arrangement having a plurality of sections or pockets provided on each side of a page. Each such pocket is capable of accommodating at least one sample. Therefore, all samples positioned on one side of the page of the sample book can be demonstrated to a customer at once.

A combination of a pocket organizer-page protector is quite popular among salespersons. Such combination facilitates attachment of a multiplicity of samples at one side of the page and protects the page against wear and tear. Structurally, such page protectors are typically made of a piece of plastic which is permanently attached to the front edge of the page by rivets or similar fasteners. Such plastic arrangement extending over the edge of the page protects it from undesirable contacts with other pages as well as from contacts with the carrying case, etc. The spaces between the adjacent rivets of the protector are typically used to receive samples forming receiving pockets between the side of the page and the interior of the page protector.

However, a substantial drawback of the existing arrangements in the field of the present invention is that the protectors are permanently connected to a sample book page and cannot be removed when it is necessary. Employment of rivets and similar permanent fasteners requires special equipment during the assembly procedure. This often increases the cost and weight of the sample book. Furthermore, while the prior art arrangement typically protects a front edge of a page, it exposes the top and bottom edges of the page areas to undesirable wear and tear.

Thus, there has been a long felt and unsolved need for a removable page protector which can be easily replaced when needed, and which does not require any special equipment during assembly. There is a further need for a simple and inexpensive arrangement providing protection for all of the portions of a page exposed to wear and tear.

SUMMARY OF THE INVENTION

One aspect of the present invention provides a removable protector for a page of a sample book consisting of a first elongated member having an inner surface and a second elongated member having an inner surface. In an assembled condition of the first and second elongated members the first and second inner surfaces define an interior cavity. A purality of connecting units removably connect the first and second elongated members and pass through the interior cavity. Each connecting unit forms a part of the first and second elongated members. In the assembled condition the interior cavity receives at least a part of a front edge of the page in such a manner that the connecting units pass through the page. The connecting units in the assembled condition of the first and second members define a multiplicity of receiving pockets along the front edge of the page so that at least one sample is insertable within each pocket. Each pocket is situated between the inner surface of one of the elongated members and a part of the front edge of the page facing the inner surface of the member.

In another aspect of the invention, the inner surfaces of the first and second members include a plurality of recesses and a plurality of projecting members. In the assembled condition the projecting members of one of the elongated members engage the recesses of the other one of the elongated members, so that each pair of the engaged recesses and projecting members form a connecting unit. The first and second elongated members are formed having substantially the identical outside periphery. Each member has the recesses and projecting members provided at corresponding locations. The first and second members are disassembled by disengaging the recesses and the corresponding projecting members.

A further aspect of the invention provides the removable protector, wherein the first elongated member is connected to the second elongated member by a flexible web and the interior cavity is formed by pivoting one of the members about the flexible web into engaged relationship with the other one of the members. A plurality of connecting pads extend outwardly from the first and second inner surfaces. The thickness of the contacting pads is greater than the thickness of the remaining inner surfaces. In the assembled condition the contacting pads of one elongated member and the contacting pads of the other elongated member engage opposite sides of the page.

A still further aspect of the present invention provides a removable protector for a page of a sample book consisting of a first unitary member having a main portion with opposite ends. First and second auxiliary portions are directed outwardly in a first direction from the opposite ends and an inner surface extends within the main portion and the first and second auxiliary portions of the first unitary member. A second unitary member is provided having a main portion with opposite ends, first and second auxiliary portions extend outwardly in the first direction from the opposite ends of the main portion. A second inner surface extends within the main and auxiliary portions of the second unitary member. In an assembled condition of the first and second unitary members the first and second inner surfaces define an interior cavity. A plurality of connecting units removably connect the first and second unitary members and pass through the interior cavity. The connecting units form a part of the first and second unitary members. In the assembled condition the interior cavity receives at least a part of a front page and corners of said page in such a manner that the connecting units pass through the page. The connecting units in the assembled condition of the first and second unitary members define a multiplicity of receiving pockets along the front edge of the page. Each pocket is formed to receive at least one sample. Each pocket is situated between the inner surface of one of the unitary members and a part of the front edge of the page facing the inner surface of the unitary member. The inner surfaces of the first and second unitary members include a plurality of recesses and a plurality of projecting members. In the assembled condition the projecting members of one of the unitary members engage the opposite recesses of the other one of the unitary members, so that each pair of engaged recesses and projecting members form a connecting unit.

In still another aspect of the invention the first and second unitary members are formed having substantially the identical outside periphery. Each member has the recesses and the projecting members provided at corresponding locations. The first and second unitary members are disassembled by disengaging the recesses and the projecting members. Prior to assembly of the removable protector, one of the unitary members is turned upside down, so that the inner surface of one of the unitary members faces the inner surface of the other unitary member.

BRIEF DESCRIPTION OF THE DRAWINGS

Other advantages and features of the invention are described with reference to exemplary embodiments which are intended to explain and not to limit the invention, and are illustrated in the drawings in which.

DETAILED DESCRIPTION OF THE PREFERRED EMBODIMENTS

Although specific embodiments of the invention will now be described with reference to the drawings, it should be understood that the embodiments shown are by way of examples only and merely illustrative of but a few of many possible specific embodiments which represent application of the principles of the invention. Various changes and modifications obvious to one skilled in the art to which the invention pertains are deemed to be within the spirit, scope and contemplation of the invention as further defined in the appended claims.

Figure 1:
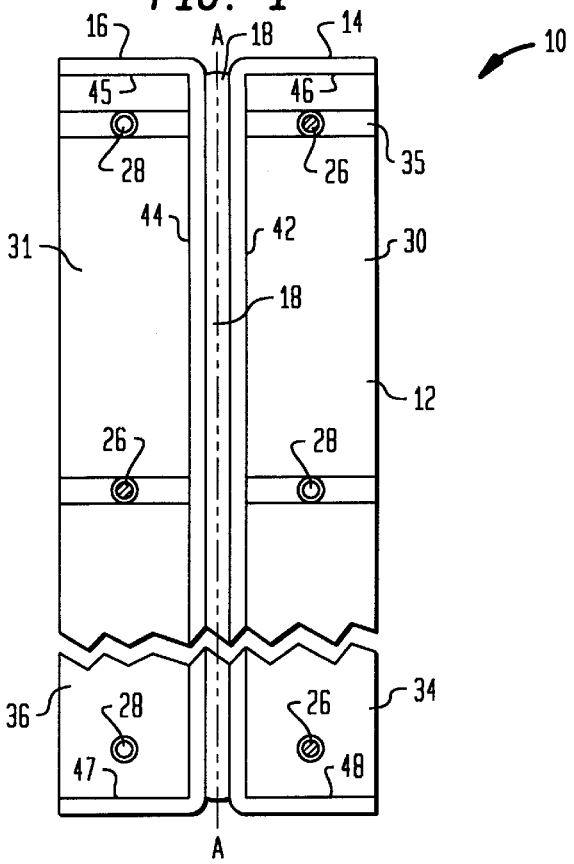
FIG. 1 is a front elevational view showing a page protector in an unassembled condition according to one embodiment of the invention.

Referring now to FIG. 1, a removable protector 10 for a page of a sample book in accordance with the present invention is depicted in an unassembled condition. The protector consists of a body 12 formed by a first elongated member 14 and a second elongated member 16. As shown in FIG. 1, the elongated members may be connected to each other by a flexible web 18. However, it should be understood that the body 12 may be formed by two members which are independent from each other.

Figure 3:
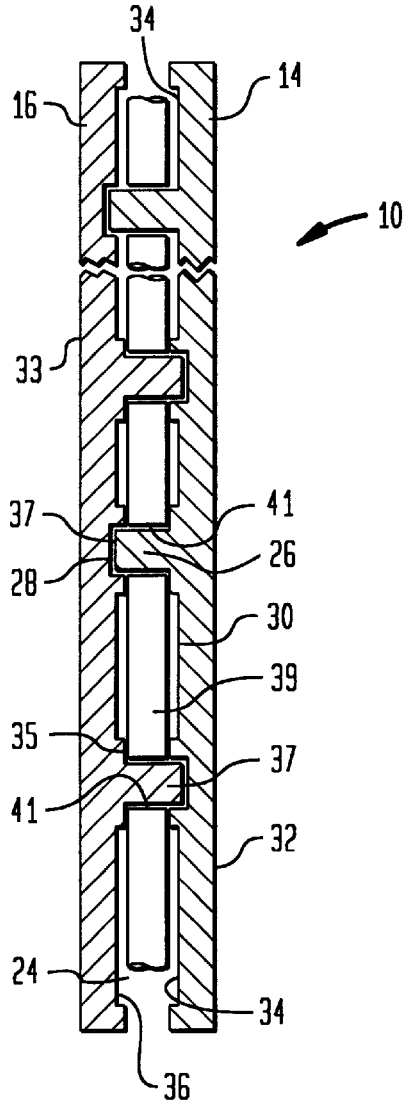
FIG. 3 is a partial cross-sectional view of the assembled page protector taken along a row of connecting units of FIG. 2.

The first elongated member 14 has an inner surface 30 and an outer surface 32, whereas the second elongated member 16 includes an inner surface 31 and an outer surface 33 (see FIG. 3). Recessed regions 34 and 36 extend within the inner areas of the elongated members. One side of each recessed region remote from the web 18 is open (see FIG. 1). This facilitates positioning of a front edge of a page into the protector of the invention. Inner boundaries of the recessed regions are defined by longitudinal walls 42, 44 extending along a longitudinal axis A—A of the protector and by auxiliary walls 46, 48, 45 and 47 positioned transverse to the longitudinal axis. The web 18 is attached to the exterior portions of the longitudinal walls 42 and 44.

Each elongated member contains a multiplicity of protruding or male members 26 and receiving female elements or recesses 28. The receiving elements 28 extend inwardly from the inner surfaces 30 and 31 of the first and second member, and the protruding elements 26 extend outwardly therefrom. The protruding and receiving elements are distributed along the recessed regions 34 and 36 of the elongated members. FIGS. 1 and 3 show the protruding elements 26 and the receiving elements 28 positioned in alternating relationship on both the first member 14 and the second member 16. In an alternate arrangement, however, the protruding elements may all be formed on one elongated member and the receiving elements may all be formed on the other member.

In the preferred embodiment of the invention, the protruding elements 26 are formed as substantially cylindrical bosses and the receiving elements 28 are sized and shaped to closely receive the protruding elements in force fit engagement. Thus, the receiving elements are formed with substantially cylindrical inner surfaces having diameters slightly larger than the diameters of the corresponding protruding elements.

Figure 4:
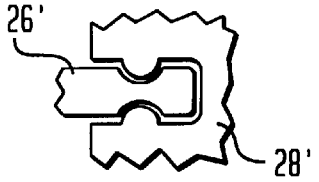
FIG. 4 shows a connecting unit according to one embodiment of the invention.
Figure 5:
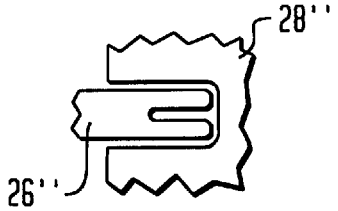
FIG. 5 shows a connecting unit according to another embodiment of the invention.

Although FIG. 1 shows the protruding and receiving elements as having a cylindrical configuration, it should be understood that any suitable configuration of these elements is within the scope of the present invention. For example, FIG. 4 illustrates a protruding member 26' formed with a groove at the free end thereof. The receiving element 28' is formed with a resilient annular ring adapted for snapping engagement with the groove of the protruding element. In the embodiment of FIG. 5 the protruding element 26" is formed with an internal slot facilitating its insertion into the corresponding receiving element 28".

To facilitate proper contacts between a page of a sample book and the inner surfaces of the elongated members, a plurality of contacting pads 31 are situated within recessed regions 34 and 36 in the areas surrounding the receiving and protruding elements. As is shown in FIG. 3, the contacting pads have a thickness greater than that of the remainder of the recessed regions.

Figure 2:
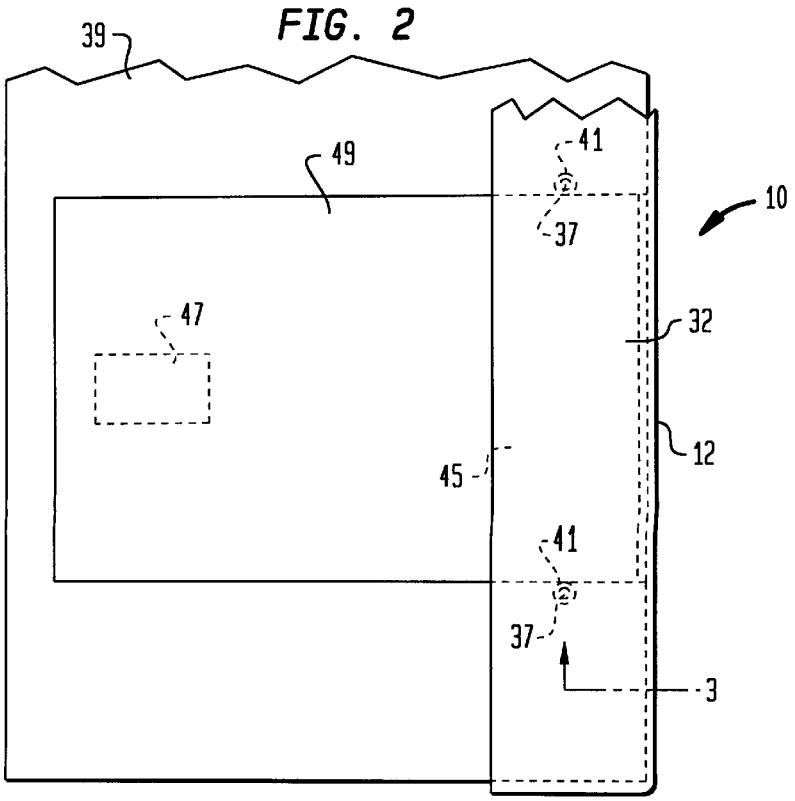
FIG. 2 is a partial front elevational view of the protector of FIG. 1 in an assembled condition showing a page of a sample book and a sample.

In order to place the protector 10 into the assembled condition, one elongated member is pivoted about the flexible web 18 into confronting relationship with the other elongated member. As illustrated in FIGS. 2 and 3, in the assembled condition of the protector 10 an interior cavity 24 is formed between the inner surfaces 30 and 31 of the first and second elongated members. As the first and second elongated members are brought together to form interior cavity 24, the protruding elements 26 of one elongated member are placed within the opposed receiving elements 28 of the other elongated member so that each pair of opposed protruding elements and receiving elements together forms a connecting unit 37. A plurality of the connecting units 37 form a connecting means or arrangement keeping together the elongated members of the protector and a page of the sample book during the operation of the device.

Each page 39 of the sample book includes openings 41 positioned along a front edge thereof. During the assembly process of the invention, in order to protect the front edge of the page including top and bottom corners thereof, the page 39 is positioned between the unassembled elongated members in such a manner that the protruding elements 26 on a first elongated member extend through the corresponding openings 41 of the page and the receiving elements 28 of the first elongated member are aligned with the remainder of the openings 41. Then, upon assembly of the second elongated member to the first elongated member, the protruding and receiving elements of both members are placed into engagement forming the connecting units 37 and the interior cavity 24. In this condition, the connecting units 37 pass through the openings 41 of the page. The interior cavity 24 of the protector receives the front edge of the page and the upper and lower corners as well as portions of the upper and lower edges of the page adjacent the corners. Thus, the entire front area of the page is covered by the protector. In this condition of the invention parts of the page 39 of the sample book are positioned between and squeezed by the contacting pads 35 preventing the page from undesirable movements.

As illustrated in FIG. 2, a plurality of receiving pockets 45 are formed on each side of the page between adjacent connecting units 37. Actually, the boundaries of each receiving pocket are defined by a surface of the page along the front edge of the page and the inner surface of the elongated member facing that surface of the page.

To provide an additional support for a sample, a plurality of securing arrangements 47 are provided in the vicinity of the rear edge of the page so that at least one securing arrangement corresponds to each pocket. The securing arrangements 47 are conventional in nature and, for example, can be made from a Velcro strip attached to the surface of the page facing the sample.

In use, as shown in FIG. 2, one end of the sample 49 is inserted into a pocket 45, and the opposite end is attached to the page of the sample book by the corresponding securing arrangement 47. In this position, movement of the sample in the direction of the longitudinal axis of the book is limited by the adjacent connecting units, and movement of the sample in the direction transverse to the longitudinal axis of the book is limited by opposed lips 42 and 44 and by the securing arrangement.

Figure 6:
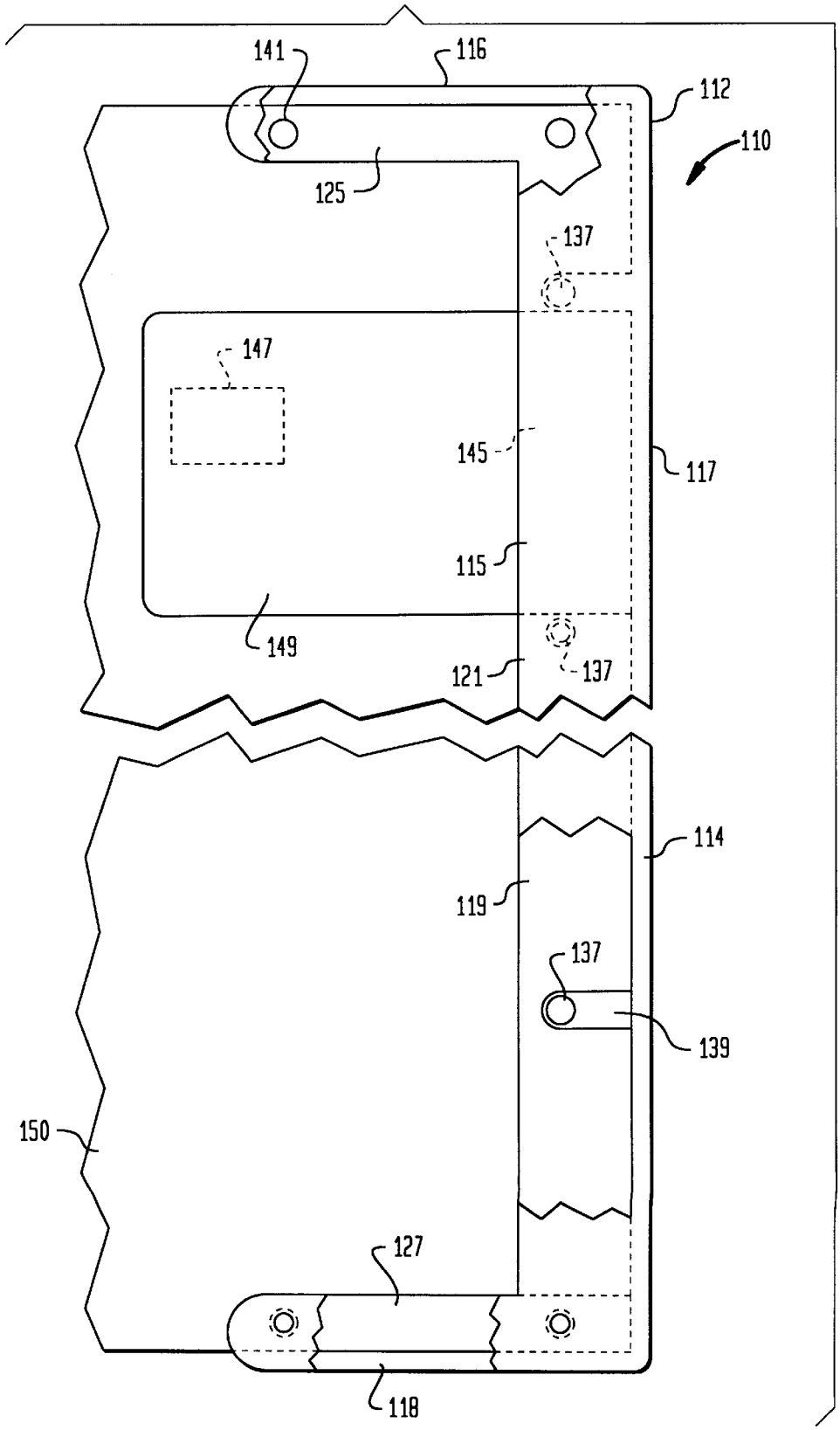
FIG. 6 is a front elevational view of a page protector according to another embodiment of the invention in an assembled condition on a page, and partially broken away to show the interior thereof.
Figure 7:
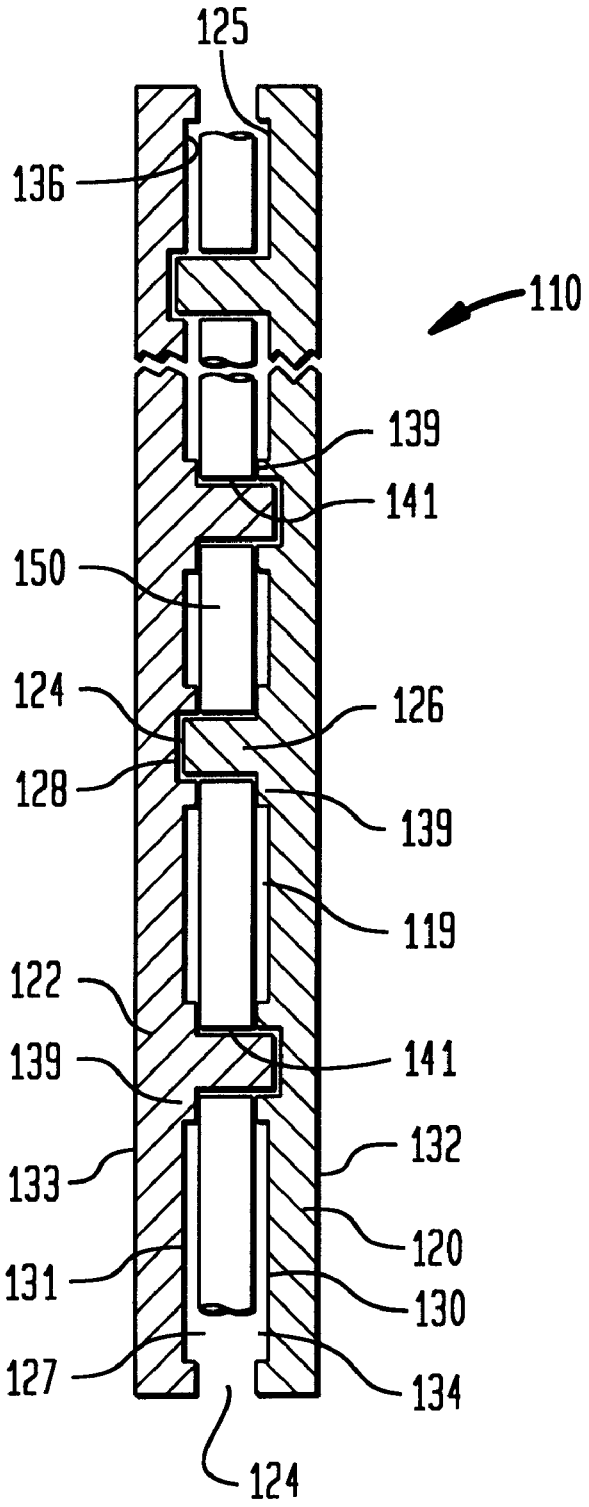
FIG. 7 is a partial cross-sectional view of the page protector taken along a row of connecting units of FIG. 6.

A page protector 110 in accordance with another embodiment of the invention is illustrated in FIGS. 6 and 7. The protector 110 consists of a body 112 having a main elongated portion 114 as well as first and second auxiliary portions 116 and 118 which extend laterally in one direction from opposite ends of the main portion. The main portion is formed with an inner edge 115 and an outer edge 117. An interior cavity 124 is provided within the body 112 and extends within the main and auxiliary portions so as to form a main portion 119, as well as first and second auxiliary portions 125 and 127 of the interior cavity. The body 112 consists of two unitary members 120 and 122. Each unitary member has an outside configuration identical to that of the body 112 including the main elongated portion and the two auxiliary portions. The unitary members are formed with inner surfaces 130, 131 and outer surfaces 132 and 133, respectively (see FIG. 7). Recessed regions 134, 136 are formed within the inner surfaces of the unitary members. Similar to the above discussed embodiment, the unitary members 120 and 122 are connected to each other by a connecting arrangement or connecting means consisting of a plurality of connecting units 137. As illustrated in FIG. 7, each connecting unit consists of a protruding or male element 126 and a receiving female element or recess 128. In this respect, the receiving elements 128 extend inwardly from the inner surfaces 130 and 131, whereas the protruding elements 126 extend outwardly therefrom. The protruding and receiving elements preferably are distributed in alternating relationship along the main and auxiliary portions of each unitary member so that each protruding member is typically followed by a receiving member and vice versa. However, in an alternate embodiment of the invention, as long as a reliable connection between two unitary members is provided, two or more receiving or protruding elements may be provided adjacent to one another along the inner surface of each unitary member. In the assembled condition, the protruding elements are connected to the receiving elements forming a plurality of connecting units 137.

The protruding and receiving elements of the main portion of each unitary member are positioned between the inner edge 115 and the outer edge 17 thereof. The receiving and protruding elements are typically spaced equidistantly along the length of the main portion 114. To provide a better engagement between the unitary members at the corners of each page, at least one connecting unit can be formed at a free end of each auxiliary portion.

To prevent undesirable movement of the page within the interior cavity 124 of the protector, a reliable engagement between the inner surfaces of the unitary members and the page is needed. For this purpose, a multiplicity of contacting pads 139 are provided within the recessed regions 134 and 136 in the areas surrounding the receiving and protruding elements. The contacting pads 139 (see FIG. 7) have a thickness greater than the thickness of the remainder of the recessed regions. Therefore, in the assembled condition of the protector the contacting pads 139 closely engage the surface of the page they are facing.

Each page 150 of the sample book includes a plurality of openings 141 formed along the front edge of the page, and at least one opening 141 formed along each of the top and bottom edges of the page at a spaced distance from the front edge. To protect the front edge of the page as well as the front corners, the protector is positioned on the page in such a manner that the connecting units 137 extend through a plurality of corresponding openings 141 within the page. Therefore, the main part of the interior cavity 124 engagably receives at least a major portion of the front edge of the page, whereas the first and second auxiliary portions 125 and 127 of the interior cavity engagably receive at least portions of the top and bottom edges of the page adjacent the top and bottom front corners thereof. In this way, the entire front area of the page is covered by the protector preventing unnecessary wear and tear.

A multiplicity of receiving pockets 145 (see FIG. 6) are formed on each side of the page between adjacent connecting units 137 provided within the main part of the interior cavity. Such receiving pockets are adapted to slidably receive at least a portion of a sample 149.

To simplify assembly of the protector and to reduce cost of the invention, the unitary members may be manufactured to be identical. The receiving and protruding elements are provided at the identical locations on the inner surfaces of the unitary members. Prior to assembly of the removable protector, one of these unitary members is turned upside down so that the inner surface of one unitary member faces the inner surface of the other unitary member. In this condition the unitary members are brought together.

To provide a support for an end of the sample 149 positioned remotely from the pocket 145, a plurality of securing arrangements 147 are placed in the vicinity of a rear edge of the page. At least one securing arrangement 147 corresponds to one pocket 145 on the page. Therefore, each sample is secured within the sample book in such a manner that one end thereof is inserted into the pocket and another end is removably connected to the same page by the securing arrangement.

I claim:

1. A page of a sample book, comprising a page having a first longitudinal edge for connection to the sample book and a free longitudinal edge including a plurality of apertures;

a first elongated member having an inner surface, a top edge, a bottom edge and a pair of side edges;

a second elongated member having an inner surface, a top edge, a bottom edge and a pair of side edges;

a side wall projecting from said inner surface of at least one of said first and second elongated members along at least one of said side edges thereof;

a plurality of connecting units for removably connecting said first and second elongated members together in an assembled condition on said free longitudinal edge of said page with said inner surface of said first elongated member separated from said inner surface of second elongated member by a spaced distance to define a cavity therebetween, said inner surface of said first elongated member facing one surface of said page and said inner surface of said second elongated member facing an opposite surface of said page, each connecting unit including a first portion formed on said inner surface of said first elongated member and a second portion formed on said inner surface of said second elongated member, whereby in said assembled condition each one of said connecting units passes through one of said plurality of apertures in said free edge of said page.

2. A page of a sample book as claimed in claim 1, further comprising a multiplicity of first receiving pockets formed along said free longitudinal edge of said page, each said first receiving pocket having an open side facing said first longitudinal edge of said page and being bounded by said one surface of said page, said inner surface of said first elongated member and at least one of said connecting units.

3. A page of a sample book as claimed in claim 2, further comprising a multiplicity of second receiving pockets formed along said free longitudinal edge of said page, each said second receiving pocket having an open side facing said first longitudinal edge of said page and being bounded by said opposite surface of said page, said inner surface of said second elongated member and at least one of said connecting units.

4. A page of a sample book as claimed in claim 1, further comprising a flexible web interconnecting said first elongated member with said second elongated member, wherein said cavity is formed by pivoting said first and second elongated members relative to one another about said flexible web to said assembled condition.

5. A page of a sample book as claimed in claim 4, wherein said side wall projects along said top edge, said bottom edge and said one of said side edges of both of said first and second elongated members so that said side wall on said first elongated member opposes said side wall on said second elongated member in said assembled condition.

6. A page of a sample book as claimed in claim 4, wherein said flexible web interconnects said one of said side edges on said first elongated member with said one of said side edges on said second elongated member, and said flexible web is positioned outside of said cavity in said assembled condition.

7. A page of a sample book as claimed in claim 1, wherein said first and second elongated members have identical structures.

8. A page of a sample book as claimed in claim 1, further comprising a first series of contacting pads extending outwardly from said inner surface of said first elongated member and having contacting surfaces spaced from said inner surface of said first elongated member, and a second series of contacting pads extending outwardly from said inner surface of said second elongated member and having contacting surfaces spaced from said inner surface of said second elongated member, said contacting surfaces of said first series of contacting pads contacting said one surface of said page in said assembled condition, and said contacting surfaces of said second series of contacting pads contacting said opposite surface of said page in said assembled condition.

9. A page of a sample book, comprising a page having a top edge, a bottom edge, a first longitudinal edge for connection to the sample book and a free longitudinal edge including a plurality of apertures, said free longitudinal edge together with said top edge defining a top corner of said page, and said free longitudinal edge together with said bottom edge defining a bottom corner of said page;

a first elongated member including a central portion having first and second ends, a first auxiliary portion projecting laterally in a first direction from said first end of said central portion, a second auxiliary portion projecting laterally in said first direction from said second end of said central portion, said first member having an inner surface, a top edge, a bottom edge, and a pair of side edges;

a second elongated member including a central portion having first and second ends, a first auxiliary portion projecting laterally in said first direction from said first end of said central portion, a second auxiliary portion projecting laterally in said first direction from said second end of said central portion, said second member having an inner surface, a top edge, a bottom edge, and a pair of side edges;

a side wall projecting from said inner surface of at least one of said first and second elongated members along at least one of said side edges thereof;

a plurality of connecting units for removably connecting said first and second elongated members together in an assembled condition on said free longitudinal edge, said top corner and said bottom corner of said page with said inner surface of said first elongated member separated from said inner surface of said second elongated member by a spaced distance to define a cavity therebetween, said inner surface of said first elongated member facing one surface of said page and said inner surface of said second elongated member facing an opposite surface of said page, each connecting unit including a first portion formed on said inner surface of said first elongated member and a second portion formed on said inner surface of said second elongated member, whereby in said assembled condition each one of said connecting units passes through one of said plurality of apertures in said free edge of said page.

10. A page of a sample book as claimed in claim 9, further comprising a multiplicity of first receiving pockets formed along said free longitudinal edge of said page, each said first receiving pocket having an open side facing said first longitudinal edge of said page and being bounded by said one surface of said page, said inner surface of said first elongated member and at least one of said connecting units.

11. A page of a sample book as claimed in claim 10, further comprising a multiplicity of second receiving pockets formed along said free longitudinal edge of said page, each said second receiving pocket having an open side facing said first longitudinal edge of said page and being bounded by said opposite surface of said page, said inner surface of said second elongated member and at least one of said connecting units.

12. A page of a sample book as claimed in claim 9, further comprising a flexible web interconnecting said first elongated member with said second elongated member, wherein said cavity is formed by pivoting said first and second elongated members relative to one another about said flexible web to said assembled condition.

13. A page of a sample book as claimed in claim 12, wherein said side wall projects along said top edge, said bottom edge and said one of said side edges of both of said first and second elongated members so that side wall on said first elongated member opposes said side wall on said second elongated member in said assembled condition.

14. A page of a sample book as claimed in claim 12, wherein said flexible web interconnects said one of said side edges on said first elongated member with said one of said side edges on said second elongated member, and said flexible web is positioned outside of said cavity in said assembled condition.

15. A page of a sample book as claimed in claim 9, further comprising a first series of contacting pads extending outwardly from said inner surface of said first elongated member and having contacting surfaces spaced from said inner surface of said first elongated member, and a second series of contacting pads extending outwardly from said inner surface of said second elongated member and having contacting surfaces spaced from said inner surface of said second elongated member, said contacting surfaces of said first series of contacting pads contacting said one surface of said page in said assembled condition, and said contacting surfaces of said second series of contacting pads contacting said opposite surface of said page in said assembled condition.

16. A page of a sample book as claimed in claim 9, wherein said first and second elongated members have identical structures.

* * * * *

UNITED STATES PATENT AND TRADEMARK OFFICE

CERTIFICATE OF CORRECTION

PATENT NO. : 6,036,396
DATED : March 14, 2000
INVENTOR(S) : Gottdiener

It is certified that error appears in the above-identified patent and that said Letters Patent is hereby corrected as shown below:

Column3,
Line 1, after "invention" insert --,--.

Column 4,
Line 42, "31" should read --35--.

Column 5,
Line 15, after "invention" insert --,--.

Column 6,
Line 14, "17" should read --117--.

Signed and Sealed this

Nineteenth Day of June, 2001

*Attest:*

Nicholas P. Godici

*Attesting Officer*

NICHOLAS P. GODICI
*Acting Director of the United States Patent and Trademark Office*